United States Patent [19]

Jones

[11] 4,199,483

[45] Apr. 22, 1980

[54] DETERGENT COMPOSITIONS CONTAINING SALICYLATE CORROSION INHIBITOR

[75] Inventor: Kenneth L. Jones, Cincinnati, Ohio

[73] Assignee: The Procter & Gamble Company, Cincinnati, Ohio

[21] Appl. No.: 17,644

[22] Filed: Mar. 5, 1979

[51] Int. Cl.[2] ..... C11D 3/20

[52] U.S. Cl. ..... 252/559; 252/89.1

[58] Field of Search ..... 252/89.1, 559, DIG. 14, 252/393, 540

[56] References Cited

U.S. PATENT DOCUMENTS

| | | | |
|---|---|---|---|
| 3,424,689 | 1/1969 | Kakegawa et al. | 252/89.1 |
| 3,801,517 | 4/1974 | Richwine | 260/45.75 R X |

FOREIGN PATENT DOCUMENTS

| | | |
|---|---|---|
| 2140822 | 1/1973 | France . |
| 342984 | 6/1972 | U.S.S.R. . |

OTHER PUBLICATIONS

Bogatyreva et al., "Sodium Salicylate as an Inhibitor of Corrosion of Steel in Neutral Media," Zhur. Prihlad. Khim. 32, 1071-1076 (1959) (CA:53:13958i).

Bogatyreva et al., "Organic Corrosion Inhibitors for Metals in Neutral Media," Uchenye Zapiski Moskov. Gosudarst. Pedagog. Inst. im. V.I. Lenina 1960, No. 146, 147-153 (CA:55:26977f).

Balezin et al., "Salts of Certain Aromatic Acids as Corrosion Inhibitors of Metals in Neutral Media," Sb. Tr. Voronezhsk. Otd. Vses. Khim. Obshchestva 1959 (2), 97-104 (CA:59:12459d).

*Primary Examiner*—Harris A. Pitlick

*Attorney, Agent, or Firm*—Robert B. Aylor; Richard C. Witte; Thomas H. O'Flaherty

[57] ABSTRACT

Described are low or no phosphate heavy-duty detergent compositions containing alkali metal, alkaline earth metal or ammonium salicylates as corrosion inhibitors. Preferably, the corrosion inhibitor herein is sodium salicylate. The detergent compositions preferably are unbuilt, liquid compositions and contain an anionic/-nonionic surfactant mixture.

14 Claims, No Drawings

DETERGENT COMPOSITIONS CONTAINING SALICYLATE CORROSION INHIBITOR

TECHNICAL FIELD

This invention relates to low or no phosphate heavy-duty detergent compositions containing alkali metal, alkaline earth metal or ammonium salicylates as corrosion inhibitors. The inclusion of these salicylates in the detergent compositions herein results in improved corrosion inhibition in washing machines exposed to dilute aqueous solutions of the detergents.

BACKGROUND ART

It is desirable to include an anti-corrosion agent in detergent compositions to inhibit the corrosion and discoloration of metal wash baskets in washing machines and to prevent the discoloration of fabrics which come in contact with the wash baskets.

Unbuilt heavy-duty detergent compositions containing minor amounts of corrosion inhibitors are known in the art. For example, see U.S. Pat. No. 4,079,078, issued to Collins on Mar. 14, 1978, which utilizes minor amounts of fatty acid and alkali metal base corrosion inhibitors; U.S. Pat. No. 4,075,118, issued to Gault et al on Feb. 21, 1978, which also utilizes minor amounts of fatty acid corrosion inhibitors; and the copending application of McGrady, Ser. No. 973,254, filed on Dec. 26, 1978, which discloses the use of a mixture of an aromatic triazole and an oligomeric olefinic fatty acid as a corrosion inhibiting system. The above disclosures are incorporated herein by reference.

The present invention embodies the discovery that alkali metal, alkaline earth metal, or ammonium salicylates are especially effective corrosion inhibitors in low or no phosphate heavy-duty detergent compositions.

Accordingly, it is an object of this invention to provide detergent compositions, especially stable liquid compositions, which exhibit excellent pretreatment and through-the-wash fabric cleaning with no or low levels of phosphate materials while delivering improved corrosion inhibition in washing machines.

SUMMARY OF THE INVENTION

The present invention encompasses a detergent composition comprising from about 20% to about 75% of a detergent surfactant; from about 1.0% to about 75% of water; and from about 0.1% to about 3.0% of an alkali metal, alkaline earth metal or ammonium salicylate; and being substantially free of phosphate materials. Sodium salicylate is a preferred corrosion inhibitor for use herein, and the detergent compositions are preferably unbuilt liquid compositions.

DISCLOSURE OF THE INVENTION

This invention embodies the discovery of improved corrosion inhibitors for use in heavy-duty detergent compositions substantially free of phosphate builder materials. Preferably, the detergent compositions described herein are also substantially free of other conventional detergent builders, such as: alkali metal borates, silicates, carbonates, bicarbonates and sulfates; organic alkaline detergency builder salts, such as water-soluble amino polyacetates, water-soluble salts of phytic acid, and water-soluble polyphosphonates; and insoluble aluminosilicate-type builder salts.

The detergent compositions of the present invention comprise three essential elements: a detergent surfactant, a salicylate corrosion inhibitor, and water.

The Detergent Surfactant

The detergent compositions of this invention comprise from about 20% to about 75% by weight, preferably from about 30% to about 60% by weight, and more preferably from about 40% to about 50% by weight, of a water-soluble detergent surfactant. Suitable detergent surfactants are anionic, cationic, nonionic, zwitterionic, semi-polar, and ampholytic surfactants, and mixtures thereof, although, the compositions herein are preferably free of cationic surfactants. Anionic, nonionic, zwitterionic, semi-polar, and ampholytic surfactants are more fully described in U.S. Pat. No. 4,075,118, Gault et al, in U.S. Pat. No. 4,079,078, Collins, and in the copending application of McGrady, Ser. No. 973,254, all of which are incorporated hereinabove by reference. Suitable cationic and cationic/nonionic surfactants are those described in copending U.S. Patent applications Ser. No. 919,341, Cockrell, filed June 26, 1978, Ser. No. 919,181, Murphy, filed June 26, 1978, and Ser. No. 962,822, Murphy, filed Nov. 22, 1978, the disclosures of which are incorporated herein by reference. Preferred surfactants for use herein are anionic and nonionic surfactants, and mixtures thereof, as hereinafter described.

Nonionic surfactants for use herein comprise the typical nonionic surface active agents well known in the detergency arts. Such materials can be succinctly described as the condensation products of an alkylene oxide (hydrophilic in nature), especially ethylene oxide (EO), with an organic hydrophobic compound, which is usually aliphatic or alkyl aromatic in nature. The length of the hydrophilic (i.e., polyoxyalkylene) moiety which is condensed with any particular hydrophobic compound can be readily adjusted to yield a water-soluble compound having the desired degree of balance between hydrophilic and lipophilic elements, i.e., the "HLB".

The HLB of the ethoxylated nonionics used herein can be experimentally determined in well-known fashion, or can be calculated in the manner set forth in Decker, EMULSIONS THEORY AND PRACTICE, Reinhold 1965, pp. 233 and 248. For example, the HLB of the nonionic surfactants herein can be simply approximated by the term: HLB=E/5; wherein E is the weight percentage of ethylene oxide content in the molecule. Of course, the HLB will vary, for a given hydrocarbyl content, with the amount of ethylene oxide.

Preferred nonionic surfactants for use in the present compositions and processes are characterized by an HLB in the range of from 9 to 20, most preferably 10 to 14.

Specific, nonlimiting examples of suitable water-soluble nonionic surfactants include the following.

The ethylene oxide condensates of alkyl phenols are a well-known type of water-soluble ethoxylated nonionic surfactant. These compounds include the condensation products of alkyl phenols having an alkyl group containing from about 6 to 18 carbon atoms in either a straight chain or branched chain configuration, with EO, said EO being present in amounts from about 1 to about 25 moles of EO per mole of alkyl phenol. The alkyl substituent in such compounds can be derived, for example, from polymerized propylene, diisobutylene, octene, or nonene. Examples of compounds of this type include nonyl phenol condensed with about 9.5 moles of EO per mole of nonyl phenol; dodecyl phenol condensed with about 12 moles of EO per mole of phenol; dinonyl phenol condensed with about 15 moles of EO per mole of phenol; and di-isooctylphenol condensed with about 15 moles of EO per mole of phenol. Commercially available nonionic surfactants of this type include Igepal CO-630, marketed by the GAF Corporation, and Triton X-45, X-114, X-100 and X-102, all marketed by the Rohm and Haas Company.

The condensation products of aliphatic alcohols with 1 to 20 moles of ethylene oxide are another (and highly preferred) type of nonionic surfactant used herein. The alkyl chain of the aliphatic alcohol can be either straight or branched, and generally contains from about 8 to about 22, preferably 9 to 16, carbon atoms. The alcohols can be primary, secondary, or tertiary. Examples of such ethoxylated alcohols include the condensation product of about 6 moles of EO with 1 mole of tridecanol; myristyl alcohol condensed with about 10 moles of EO per mole of myristyl alcohol; the condensation product of EO with coconut fatty alcohol wherein the coconut alcohol is primarily a mixture of fatty alcohols with alkyl chains varying from 10 to about 16 carbon atoms in length and wherein the condensate contains about 6 moles of EO per mole of total alcohol; and the condensation product of about 9 moles of EO with the above-described coconut alcohol. Tallow alcohol ethoxylates $(EO)_6$ to $(EO)_{11}$ are similarly useful herein. Examples of commercially available nonionic surfactants of the foregoing type include Tergitol 15-S-9, marketed by the Union Carbide Corporation; Neodol 23-6.5, marketed by the Shell Chemical Company; and Kyro EOB, marketed by The Procter & Gamble Company.

The condensation products of ethylene oxide with a hydrophobic base formed by the condensation of propylene oxide with propylene glycol constitute another type of nonionic surfactant. The hydrophobic portion of these compounds has a molecular weight of from about 1500 to 18,000 and, of course, exhibits water insolubility. The addition of poly-EO moieties to this hydrophobic portion tends to increase the water-solubility of the molecule as a whole, and the liquid character of the product is retained up to the point where the EO content is about 50% of the total weight of the condensation product. Examples of compounds of this type include certain of the commercially available Pluronic surfactants, marketed by BASF Wyandotte.

The condensation products of ethylene oxide with the product resulting from the reaction of propylene oxide and ethylenediamine are another type of nonionic surfactant useful herein. The hydrophobic "base" of these condensation products consists of the reaction product of ethylenediamine and excess propylene oxide, said base having a molecular weight of from about 2500 to about 3000. This base compound is thereafter condensed with EO to the extent that the condensation product contains from about 40% to about 80% by weight of poly-EO and has a molecular weight of from about 5,000 to about 11,000. Examples of this type of nonionic surfactant include certain of the commercially available Tetronic compounds, marketed by BASF Wyandotte.

The highly preferred nonionic surfactants herein include the $EO_1$–$EO_{20}$ condensates of $C_9$ to $C_{18}$ primary and secondary alcohols; the condensates of primary alcohols are most preferred. Nonlimiting, specific examples of nonionic surfactants of this type are as follows (the abbreviations used for the nonionic surfactants, e.g., $C_{14}(EO)_6$, are standard for such materials and describe the carbon content of the lipophilic portion of the molecule and the ethylene oxide content of the hydrophilic portion): n-$C_{14}H_{29}(EO)_5$; n-$C_{14}H_{29}(EO)_6$; n-$C_{14}H_{29}(EO)_7$; n-$C_{14}H_{29}(EO)_{10}$; n-$C_{15}H_{31}(EO)_6$; n-$C_{15}H_{31}(EO)_7$; 2-$C_{15}H_{31}(EO)_7$; n-$C_{15}H_{31}(EO)_8$; 2-$C_{15}H_{31}(EO)_8$; n-$C_{15}H_{31}(EO)_9$; 2-$C_{15}H_{31}(EO)_9$; n-$C_{16}H_{33}(EO)_9$; and 2-$C_{16}H_{33}(EO)_9$.

It is to be recognized that mixtures of the foregoing nonionic surfactants are also useful herein and are readily available from commercial alcohol mixtures.

It will be appreciated that the degree of ethoxylation in the nonionics listed herein can vary somewhat, inasmuch as average fractional degrees of ethoxylation occur. For example, n-$C_{15}H_{31}(EO)_7$ can contain small quantities of n-$C_{15}H_{31}(EO)_0$ and n-$C_{15}H_{31}(EO)_{14}$. Commercial mixtures will contain portions of materials of varying EO contents, and the stated EO content represents an average. Such mixtures are quite suitable for use in the present compositions and processes.

Highly preferred alcohol-based nonionic surfactants are the $C_{14\text{-}15}(EO)_{6\text{-}9}$ materials disclosed hereinabove, which are commercially available as mixtures under the names Neodol 45-7 and Neodol 45-9 from the Shell Chemical Co. Neodol 45-7 is a liquid at ambient temperatures (and is preferred herein for that reason) whereas Neodol 45-9 is a solid at room temperature. However, solid nonionics such as Neodol 45-9 are also useful in the instant liquid compositions inasmuch as they readily dissolve therein. Other highly preferred nonionics include Dobanol 91-8 ("OXO"-based alcohol from Shell) and Softanol, available from Nippon Shokubei.

When using commercial nonionic mixtures, especially of lower ($C_9$–$C_{10}$) alkyl chain length, it is preferred that the unethoxylated alcohols and lower $(EO)_1$-$(EO)_2$ ethoxylates be removed, or "stripped," to reduce undesirable odors. Stripping can be done in vacuo or by standard distillation means.

The preferred nonionic materials herein are alcohols having a carbon content of from $C_9$ to about $C_{18}$ condensed with from about 2 (avg.) moles to about 12 (avg.) moles of ethylene oxide per mole of alcohol, and further characterized by an HLB within the range of from about 8 to about 15, preferably from about 9 to about 14. Nonionic surfactants falling within these ranges are highly preferred herein from the standpoint of optimal pre-treatment cleansing, optimal through-the-wash cleansing and product stability.

Other useful nonionic surfactants include those described in U.S. Pat. No. 3,963,649, Spadini et al, issued on June 15, 1976, incorporated herein by reference. These include water-soluble tertiary amine oxides; water-soluble tertiary phosphine oxides; water-soluble amides; and other water-soluble condensation products, obtained by condensing from about 1 to about 25 moles of ethylene oxide with one mole of organic, hydrophobic compound, aliphatic or alkyl aromatic in nature, having 8 to 24 carbon atoms, and at least one reactive hydrogen atom, preferably a reactive hydroxyl, amino, amido, or carboxy group. General examples of these condensation products, along with those discussed earlier, include the condensates of ethylene oxide with fatty acid esters; polyethenoxy esters or esters obtained by reacting ethylene oxide with carboxylic acids; condensation products of fatty acyl alkanolamides with ethylene oxide; and condensation products of $C_8$–$C_{18}$ alkyl, $C_8$–$C_{18}$ alkenyl and $C_5$–$C_{18}$ alkylaryl amines and ethylene oxide.

Anionic surfactants useful herein can be an organic sulfuric reaction product having in its molecular structure an alkyl, aryl, alkaryl or aralkyl group containing from about 6 to about 22 carbon atoms and a sulfonic acid or sulfuric acid ester group, or mixtures thereof. (Included in the term "alkyl" is the alkyl portion of acyl groups). Examples of this group of synthetic detersive surfactants which can be used in the present invention are the alkyl sulfates, especially those obtained by sulfating the higher alcohols ($C_8$–$C_{18}$ carbon atoms) produced from the glycerides of tallow or coconut oil; and alkylbenzene sulfonates, in which the alkyl group contains from about 9 to about 15 carbon atoms, in straight chain or branched chain configuration, e.g., those of the type described in U.S. Pat. Nos. 2,220,099 and 2,477,383, incorporated herein by reference. Linear straight chain alkyl benzene sulfonates in which the average of the alkyl groups is about 13 carbon atoms, abbreviated as $C_{13}$LAS as well as mixed $C_{11.2}$ and $C_{11.8}$ (avg.) LAS are typically used. $C_{11}$–$C_{14}$ branched chain alkylbenzene sulfonates (ABS), which are excellent sudsers, can also be used.

Examples of commercially available alkylbenzene sulfonates (free acid form) useful in the instant invention include Conoco SA 515, SA 597, and SA 697, all marketed by the Continental Oil Company, and Calsoft LAS 99, marketed by the Pilot Chemical Company.

Other anionic surfactant compounds herein include the alkyl glyceryl ether sulfonates, especially those ethers of higher alcohols derived from tallow and coconut oil; coconut oil fatty acid monoglyceride sulfonates and sulfates; and alkyl phenol ethylene oxide ether sulfates containing about 1 to about 10 units of ethylene oxide per molecule and wherein the alkyl groups contain about 8 to about 12 carbon atoms.

Other useful anionic surfactants herein include the esters of alpha-sulfonated fatty acids containing from about 6 to 20 carbon atoms in the ester group; 2-acyloxyalkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Anionic surfactants based on the higher fatty acids, i.e., "soaps" are useful anionic surfactants herein. Higher fatty acids containing from about 8 to about 24 carbon atoms and preferably from about 10 to about 20 carbon atoms are useful anionic surfactants in the present compositions. Particularly useful are the soaps derivable from the mixtures of fatty acids made from coconut oil and tallow.

Preferred water-soluble anionic organic surfactants herein include linear and branched alkylbenzene sulfonates containing from about 10 to about 18 carbon atoms in the alkyl group; the tallow range alkyl sulfates; the coconut range alkyl glyceryl ether sulfonates; alkyl ether (ethoxylated) sulfates wherein the alkyl moiety contains from about 12 to 18 carbon atoms and wherein the average degree of ethoxylation varies between 1 and 12, especially 3 to 9, more especially 6 to 9, moles of ethylene oxide; olefin sulfonates containing from about 14 to 16 carbon atoms; and soaps, as hereinabove defined.

Specific preferred anionics for use herein include: the linear $C_9$–$C_{15}$ alkylbenzene sulfonates (LAS); the branched $C_9$ to $C_{15}$ alkylbenzene sulfonates (ABS); the tallow alkyl sulfates, the coconut alkyl glyceryl ether sulfonates; the sulfated condensation products of mixed $C_{10}$–$C_{18}$ fatty alcohols with from about 1 to about 14 moles of ethylene oxide; and the mixtures of higher fatty acid soaps containing from 10 to 18 carbon atoms.

It is to be recognized that any of the foregoing anionic surfactants can be used separately herein or as mixtures. Moreover, commercial grades of the surfactants can contain noninterfering components which are processing by-products. For example, commercial $C_{10}$–$C_{14}$ alkaryl sulfonates can comprise alkylbenzene sulfonates, alkyl toluene sulfonates, alkyl naphthalene sulfonates and alkyl poly-benzenoid sulfonates. Such material and mixtures thereof are fully contemplated for use herein.

The anionic detergents can be used in the form of their sodium; potassium; ammonium; mono-, di-, or triethanol-ammonium; calcium; or magnesium salts, or mixtures thereof. Mixtures of anionic detergents are desirable. Sodium and magnesium salts are preferred and magnesium salts are most preferred.

Especially preferred as a surfactant system is a mixture of a nonionic surfactant produced by the condensation of from about 5 moles to about 11 moles of ethylene oxide with one mole of a $C_{13}$ to $C_{16}$ alcohol, said nonionic surfactant being characterized by an HLB of from about 9.5 to about 15; and an anionic surfactant which is a mixture of an alkanolamine and an alkali metal salt of an alkylbenzene sulfonic acid where the alkyl group contains from about 9 to about 15 carbon atoms and wherein said alkanolamine is selected from the group consisting of mono-, di-, and triethanolamines and said alkali metal is selected from the group consisting of sodium, potassium, magnesium, and calcium. Even more preferably, the nonionic surfactant in the above-described surfactant system is a condensate of from about 6 to 9 moles of ethylene oxide with a $C_{14\text{-}15}$ alcohol and has an HLB within the range of 11 to 13, and the anionic surfactant is a mixture of the above-described alkanolamines and the alkali metal salts of a $C_{10\text{-}13}$ alkylbenzene sulfonic acid.

The Corrosion Inhibitor

As a second essential element, the instant compositions comprise from about 0.1% to about 3.0% by weight, preferably from about 1.0% to about 2.0% by weight, of an alkali metal, alkaline earth metal, or ammonium salicylate. Preferably, the salicylate corrosion inhibitor is an alkali metal salicylate, and more preferably is sodium salicylate. As used herein, the term "salicylate" is intended to also describe and include the salicylic acids thereof (present in wash solutions having a pH less than 7) and substituted salicylates, wherein one or more of the hydrogen atoms is replaced with a halogen atom, particularly chlorine or bromine, with hydroxy, straight and branched chain $C_1$–$C_4$ alkyl, hydroxyalkyl, alkenyl, and alkaryl moieties, or with an acyl group of formula $$O{=}\overset{|}{C}{-}R,$$

wherein R is selected from the group consisting of hydrogen, hydroxy, a halogen atom, particularly chlorine or bromine, straight and branched chain $C_1$–$C_4$ alkyl, hydroxyalkyl, alkenyl, and alkylaryl moieties.

The corrosion inhibitor herein is preferably incorporated into the detergent compositions of the present invention as the final ingredient, but can be incorporated earlier during the processing of the detergent compositions. The corrosion inhibiting agents can also be added separately to the detergent compositions described herein.

While not intending to be limited by theory, it is believed that the salicylate corrosion inhibitors herein are especially effective because they are non-sequestering aromatic chelating agents capable of forming stable 5 or 6 membered rings with iron ions in the steel wall of washing machines. The $\pi$-electrons in the aromatic ring of these corrosion inhibitors are believed to be polarized by cationic adsorption sites in faults in the procelain-covered, steel wall of the washing machine. Such an adsorption mechanism is believed to assist the inhibitive film in its adherence to the washer wall. Hypothetically, the chelating ability of the corrosion inhibitors herein also contributes to its substantivity and probably reduces the corrosion rate by slowing down the rate at which iron ions escape into the bulk of the wash water. Finally, the hydrophobicity of the aromatic ring of the inhibitors herein is also believed to aid corrosion inhibition by reducing the extent of diffusion of corrosive, water soluble materials to exposed metal of the washing machine wall.

The salicylate corrosion inhibitors herein are believed to be especially effective in detergent compositions which contain relatively high levels, especially greater than 25% by weight of the overall composition, of the linear alkylbenzene sulfonate anionic surfactants discussed hereinabove.

Water

Water, in an amount of from about 1.0% to about 75%, preferably from about 10% to about 65%, most preferably from about 25% to about 50%, by weight of the detergent composition, is a third essential element of this invention.

Optional Ingredients

Other components conventionally found in heavy-duty detergent compositions, which are more fully described in U.S. Pat. Nos. 4,075,118 and 4,079,078, incorporated hereinabove by reference, can be included in the instant compositions. More specifically, these optional components can include alkanolamine compounds, alkali metal bases, alcohol solvents, electrolyte salts, color stabilizing agents, suds modifying agents, fabric softeners, static control agents, soil suspending agents, soil release agents, germicides, pH adjusting agents, hydrotropes, perfumes, brighteners, flourescers, enzymes, bleaching agents, bleach activators, antimicrobial agents and coloring agents.

As used herein, all percentages, parts and ratios given are "by weight", unless otherwise specified.

The following nonlimiting examples illustrate the compositions of the present invention.

EXAMPLE I

The following unbuilt storage-stable liquid detergent composition was produced:

| Composition A | |
|---|---|
| Component | Wt. % |
| $C_{14-15}(EO)_7$* | 15.0 |
| $C_{11.4}$ linear alkylbenzene sulfonic acid | 30.2 |
| Magnesium hydroxide | 2.7 |
| Ethanol | 6.5 |
| Triethanolamine | 3.0 |
| Sodium salicylate | 1.0 |
| Citric acid | 0.1 |
| Perfume, brightener, dye | 1.12 |
| Water | Balance to 100 |

*Condensation product of $C_{14-15}$ alcohol with 7 moles of ethylene oxide, commercially available as Neodol 45-7, from Shell Chemical Corporation.

The above composition provided excellent fabric cleaning when used either full strength as a pretreatment or for through-the-wash detergency at a level of about ¼ cup usage per 17 gallons of wash water. Moreover, the composition was stable and provided a corrosion inhibition effect to the steel surface of a washing machine wherein the composition was used. The corrosion inhibition provided by the sodium salicylate was greater than that provided by conventional corrosion inhibitors, as will be demonstrated by the following example.

Substantially similar corrosion inhibiting benefits are obtained when the sodium salicylate is replaced with any alkali metal, alkaline earth metal, or ammonium salicylate.

Substantially similar corrosion inhibiting benefits are obtained when the anionic/nonionic surfactant mixture of Composition A is replaced with other detergent surfactants selected from the group consisting of nonionic surfactants, anionic surfactants and mixtures thereof; especially when replaced with any mixture of a nonionic surfactant produced by the condensation of from about 5 moles to about 11 moles of ethylene oxide with one mole of a $C_{13}$ to $C_{16}$ alcohol, said nonionic surfactant being characterized by an HLB of from about 9.5 to about 15; and an anionic surfactant which is a mixture of an alkanolamine and an alkali metal salt of an alkylbenzene sulfonic acid where the alkyl group contains from about 9 to about 15 carbon atoms and wherein said alkanolamine is selected from the group consisting of mono-, di-, and triethanolamines and said alkali metal is selected from the group consisting of sodium, potassium, magnesium, and calcium.

EXAMPLE II

The following unbuilt storage-stable liquid detergent compositions were produced:

| Composition B (Control) | |
|---|---|
| Component | Wt. % |
| $C_{14-15}(EO)_7$* | 15.0 |
| $C_{11.4}$ linear alkylbenzene sulfonic acid | 30.2 |
| Magnesium hydroxide | 2.7 |
| Ethanol | 6.5 |
| Triethanolamine | 3.0 |
| Di-sodium phthalate | 1.5 |
| Citric acid | 0.1 |
| Perfume, brightener, dye | 1.12 |
| Water | Balance to 100 |

*Commercially available as Neodol 45-7

| Composition C (Control) | |
|---|---|
| Component | Wt. % |
| $C_{14-15}(EO)_7$* | 15.0 |
| $C_{11.4}$ linear alkylbenzene sulfonic acid | 30.2 |
| Magnesium hydroxide | 2.7 |
| Ethanol | 6.5 |
| Triethanolamine | 2.5 |
| Benzotriazole | 0.9 |
| Citric acid | 0.1 |
| Perfume, brightener, dye | 1.12 |
| Water | Balance to 100 |

*Commercially available as Neodol 45-7

Compositions A (from Example I), B, and C were used in separate Kenmore washing machines equipped with 1976 Stipple wash baskets (which have representative porcelain finishes) at a level of about ¼ cup usage per 17 gallons of wash water. The water hardness was about 5 grains per gallon (mixed calcium and magnesium) and the wash temperature was about 130° F. Rust cells visible on the interior of the wash basket of the washing machines were counted after a certain number of wash cycles, using the above-described detergent compositions. The results were as follows:

| Corrosion Inhibitor | Cycles | Rust Cells |
|---|---|---|
| 1.5% Di-sodium phthalate | 331 | 400 |
| 1.0% Sodium salicylate | 492 | 33 |
| 0.9% Benzotriazole | 184 | 322 |

The results demonstrate the sodium salicylate is a clearly superior corrosion inhibitor for phosphate-free heavy-duty liquid detergent compositions, when compared against such conventional corrosion inhibitors as di-sodium phthalate and benzotriazole.

EXAMPLE III

The following unbuilt storage-stable liquid detergent compositions were produced:

| Composition D | |
|---|---|
| Component | Wt. % |
| $C_{14-15}$ $(EO)_7$* | 15.0 |
| $C_{11.4}$ linear alkylbenzene sulfonic acid | 30.2 |
| Magnesium hydroxide | 2.7 |
| Ethanol | 6.5 |
| Triethanolamine | 3.0 |
| Sodium salicylate | 1.0 |
| Sodium gluconate | 1.0 |
| Citric acid | 0.1 |
| Perfume, brightener, dye | 1.12 |
| Water | Balance to 100 |

*Commercially available as Neodol 45-7.

| Composition E (Control) | |
|---|---|
| Component | Wt. % |
| $C_{14-15}$ $(EO)_7$* | 15.0 |
| $C_{11.4}$ linear alkylbenzene sulfonic acid | 30.2 |
| Magnesium hydroxide | 2.7 |
| Ethanol | 6.5 |
| Triethanolamine | 3.0 |
| Sodium benzoate | 1.0 |
| Sodium gluconate | 1.0 |
| Citric acid | 0.1 |
| Perfume, brightener, dye | 1.12 |

-continued

| Composition E (Control) | |
|---|---|
| Component | Wt. % |
| Water | Balance to 100 |

*Commercially available as Neodol 45-7

A polarization test method was developed to rapidly screen corrosion inhibitors for liquid laundry detergent compositions. The test was found to be predictive of full scale wash basket rusting. The method involved applying a constant voltage potential across two carbon steel wires immersed in a detergent solution for a definite time period. After changing to a rinse solution, the voltage was then varied from zero to one volt and the resulting current flowing through the wires was measured at each voltage increment. The number of millivolts required to reach a current flow of 200 microamperes was chosen as a convenient reference point. The number of millivolts is largest when a passive film is deposited on the steel wires while immersed in a detergent composition containing the corrosion inhibitor, and the number is smallest when there is an active corroding surface with little or no protective film on the wires.

The test procedure was as follows. Carbon steel wire was cut to 3 and 4 inch lengths. One end of each wire was sanded with #180 silicon carbide paper. Alphlex tubing was cut into 2 inch lengths, placed over the steel wire, and heat shrunk allowing 1 inch of the 4 inch wire and ¼ inch of the 3 inch wire to be exposed. The two steel probes were placed parallel to each other and joined with two ½ inch long, ¼ inch outer diameter, ⅛ inch inner diameter, tygon tubing pieces. Detergent solutions (192 ml) were prepared containing 0.192 grams of Compositions D and E respectively, and were poured into 250 ml. beakers. A pluro-stopper, with its center removed and the wire electrodes inserted (sanded end down), was placed in each beaker. Alligator clamps connected the exposed ends of the steel wires to the ammeter/potentiostat so that the positive lead was attached to the longer wire. A potential of 1000 mv. was applied for 21 hours, with continuous agitation of the detergent solutions. The detergent solutions were then replaced with rinse water having a hardness of 5 grains per gallon. As a control, another steel wire electrode was prepared and inserted into a beaker containing rinse water having a hardness of 5 grains per gallon. Measurements of amperage versus voltage were taken. The voltage required to produce an amperage of 200 μA was recorded. The results were as follows:

| Detergent Solution | mv at 200μA |
|---|---|
| Composition D containing 1.0% sodium salicylate | 660 |
| Composition E containing 1.0% sodium benzoate | 610 |
| Rinse water (control) | 576 |

These results demonstrate that sodium salicylate delivers substantially better corrosion inhibition than sodium benzoate, a conventional corrosion inhibitor, when included in a phosphate-free liquid detergent composition.

What is claimed is:

1. A detergent composition comprising from about 20% to about 75% of a detergent surfactant; from about 1.0% to about 75% of water; and from about 0.1% to about 3.0% of an alkali metal, alkaline earth metal or ammonium salicylate; and being substantially free of phosphate materials.

2. The composition of claim 1 comprising from about 1.0% to about 2.0% of the salicylate.

3. The composition of claim 1 wherein the salicylate is an alkali metal salicylate.

4. The composition of claim 3 wherein the salicylate is sodium salicylate.

5. The composition of claim 1 comprising from about 30% to about 60% of the detergent surfactant.

6. The composition of claim 5 comprising from about 40% to about 50% of the detergent surfactant.

7. The composition of claim 1 wherein the detergent surfactant comprises an anionic surfactant which represents greater than 20% by weight of the composition.

8. The composition of claim 1 wherein the detergent surfactant is selected from the group consisting of anionic, nonionic, zwitterionic, semi-polar, and ampholytic surfactants, and mixtures thereof.

9. The composition of claim 8 wherein the detergent surfactant is selected from the group consisting of anionic and nonionic surfactants, and mixtures thereof.

10. The composition of claim 9 wherein the detergent surfactant is a mixture of a nonionic surfactant produced by the condensation of from about 5 moles to about 11 moles of ethylene oxide with one mole of a $C_{13}$ to $C_{16}$ alcohol, said nonionic surfactant being characterized by an HLB of from about 9.5 to about 15; and an anionic surfactant which is a mixture of an alkanolamine and an alkali metal salt of an alkyl benzene sulfonic acid where the alkyl group contains from about 9 to about 15 carbon atoms and wherein said alkanolamine is selected from the group consisting of mono-, di-, and triethanolamines and said alkali metal is selected from the group consisting of sodium, potassium, magnesium, and calcium.

11. The composition of claim 10 comprising from about 1.0% to about 2.0% of sodium salicylate.

12. The composition of claim 11 wherein the nonionic surfactant is a condensate of from about 6 to 9 moles of ethylene oxide with a $C_{14-15}$ alcohol and has an HLB within the range of 11 to 13, and the anionic surfactant is a mixture of the alkanolamine and the alkali metal salt of a $C_{10-13}$ alkyl benzene sulfonic acid.

13. The composition of claims 1 or 11 comprising from about 25% to about 50% of water.

14. The composition of claim 13 being substantially free of detergent builder materials.

* * * * *